US005223653A

United States Patent [19]

Kunimoto et al.

[11] Patent Number: 5,223,653

[45] Date of Patent: Jun. 29, 1993

[54] MUSICAL TONE SYNTHESIZING APPARATUS

[75] Inventors: Toshifumi Kunimoto; Chifumi Takeuchi, both of Hamamatsu, Japan

[73] Assignee: Yamaha Corporation, Hamamatsu, Japan

[21] Appl. No.: 524,137

[22] Filed: May 15, 1990

[30] Foreign Application Priority Data

May 15, 1989 [JP] Japan ..... 1-121230
May 26, 1989 [JP] Japan ..... 1-133724

[51] Int. Cl.[5] ..... G10H 1/14; G10H 5/04

[52] U.S. Cl. ..... 84/624; 84/659; 84/694; 84/DIG. 9; 84/DIG. 10; 364/724.17

[58] Field of Search ..... 84/624, 659, 694, 622, 84/692, DIG. 9, DIG. 10; 364/724.01, 724.07, 724.17

[56] References Cited

U.S. PATENT DOCUMENTS 2,379,744 7/1945 Pfleger ..... 84/DIG. 9
4,066,881 1/1978 Houdard ..... 364/724.17 X
4,655,115 4/1987 Nishimoto ..... 84/DIG. 10
4,785,706 11/1988 Toshifumi ..... 84/DIG. 10
4,984,276 1/1991 Smith ..... 84/630
5,000,074 3/1991 Inoue et al. ..... 84/621

*Primary Examiner*—William M. Shoop, Jr.
*Assistant Examiner*—Brian Sircus
*Attorney, Agent, or Firm*—Graham & James

[57] ABSTRACT

A musical tone synthesizing apparatus which is suitable for simulating and synthesizing the percussion instrument tone provides a closed-loop including at least an adder and a delay circuit. An input signal corresponding to a musical tone signal to be synthesized is supplied to the adder from an external device. The adder adds the input signal to its feedback signal. The output of adder is delayed by a delay time in the delay circuit, wherein delay time is controlled by a modulation signal. Then, delayed output of the delay circuit is fed back to the adder as the feedback signal. Thus, the output of adder or a signal propagating the delay circuit is picked up as a synthesized musical tone signal. Preferably, it is possible to provide a plurality of delay circuits.

3 Claims, 6 Drawing Sheets

MUSICAL TONE SYNTHESIZING APPARATUS

BACKGROUND OF THE INVENTION

1. Field of the Invention

The present invention relates to a musical tone synthesizing apparatus which is suitable for synthesizing a percussion instrument tone.

2. Prior Art

Conventionally, Japanese Patent Laid-Open Publication No. 63-40199 discloses the apparatus capable of synthesizing the sound of non-electronic musical instrument by use of a simulation model which simulates the tone-generation mechanism of non-electronic musical instrument. In case of the wind instrument, when the resonance state is established between the non-linear vibration of the read which is produced by the breath pressure applied thereto and the vibration of the compression wave of air which is produced in the resonance tube by the non-linear vibration of the reed, the musical tone is sounded from the wind instrument. Herein, the musical tone synthesizing apparatus for the wind instrument can be embodied by using the non-linear amplifier which simulates the reed operation and bi-directional transmission circuit simulating the tube through which the compression wave of air propagates.

FIG. 1 shows the known musical tone synthesizing apparatus capable of generating the synthesized percussion instrument tone. In FIG. 1, a closed-loop is constructed by an adder 1, a delay circuit 2 and a filter 3. This closed-loop functions as the resonance circuit corresponding to the resonance system of the percussion instrument. Herein, delay time of the delay circuit 2 and transmission-frequency characteristic of the filter 3 are determined in response to the resonance characteristic and delay characteristic of the percussion instrument to be simulated.

In order to generate the percussion instrument tone from this musical tone synthesizing apparatus, an impulse signal containing a plenty of different frequency components is applied to the adder 1. Such impulse signal is delayed by the delay circuit 2, attenuated by the filter 3 and then fed back to the adder 1. As described heretofore, the impulse signal is repeatedly circulating the closed-loop. As a result, the adder 1 can output the signal wherein the envelope is attenuated in lapse of time and each of its frequency components is varied in lapse of time. Thus, it is possible to synthesize the musical tone which is similar to the sound of percussion instrument.

According to the physical analysis, the tone-generation mechanism of the percussion treatment can be represented by the physically continued vibration medium (e.g., cymbal can be represented by one metal plate). When sounding the percussion tone, the vibration including a plenty of different vibration frequencies is effected on the vibration medium in circulating manner. In the case where the vibration including many kinds of frequency components propagates through the vibration medium, the frequency components interferes with each other so that each frequency component must be modulated in the actual play of the percussion instrument. Such phenomenon becomes remarkable in case of the cymbal. However, the conventional musical tone synthesizing apparatus is not designed to reproduce the above-mentioned mutual interference between the frequency components of the vibration to be produced. Thus, there is a problem in that the conventional apparatus cannot synthesize the musical tone which realizes the actual percussion instrument tone and whose tone color is full of variety like the rear percussion instrument.

SUMMARY OF THE INVENTION

It is accordingly a primary object of the present invention to provide a musical tone synthesizing apparatus capable of simulating the real tone-generation mechanism of the percussion instrument with accuracy.

In a first aspect of the present invention, there is provided a musical tone synthesizing apparatus comprising:

(a) adder means for adding its input signal to a feedback signal;

(b) means for generating a modulation signal;

(c) first delay means for delaying an output of the adder means by a predetermined delay time so that its delayed output is fed back to the adder as the feedback signal; and (d) second delay means for delaying a signal propagating the first delay means by a variable delay time which is controlled by the modulation signal;

whereby the input signal is applied to the adder means from an external device so that an output of the second delay means is picked up as a synthesized musical tone signal.

In a second aspect of the present, there is provided a musical tone synthesizing apparatus comprising:

(a) adder means for adding its input signal to a feedback signal;

(b) means for generating a modulation signal; and (c) delay means for delaying an output of the adder means by a delay time which is controlled by the modulation signal so that its delayed output is fed back to the adder as the feedback signal, whereby the input signal is applied to the adder means from an external device so that an output of the adder means or a signal propagating the delay means is picked up as a synthesized musical tone signal.

In a third aspect of the present invention, there is provided a musical tone synthesizing apparatus comprising:

(a) adder means for adding a plurality of feedback signals to its input signal supplied from an external device; and (b) a plurality of delay means each delaying an output of the adder means by its specific delay time, so that delayed outputs of the plurality of delay mean are fed back to the adder means as the plurality of feedback signals, whereby the output of the adder means or any one of the delayed outputs of the plurality of delay means is picked up as a synthesized musical tone signal.

BRIEF DESCRIPTION OF THE DRAWINGS

Further objects and advantages of the present invention will be apparent from the following description, reference being had to the accompanying drawings wherein preferred embodiments of the present invention are clearly shown.

In the drawings.

DESCRIPTION OF THE PREFERRED EMBODIMENTS

Next, description will be given with respect to the preferred embodiments of the present invention.

[A] FIRST EMBODIMENT

Figure 1:
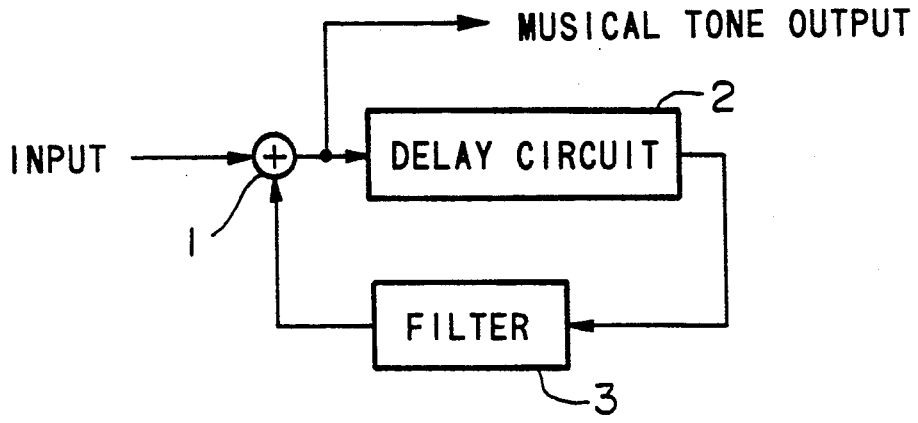
FIG.1 (PRIOR ART)
FIG. 1 is a block diagram showing the conventional musical tone synthesizing apparatus.
Figure 2:
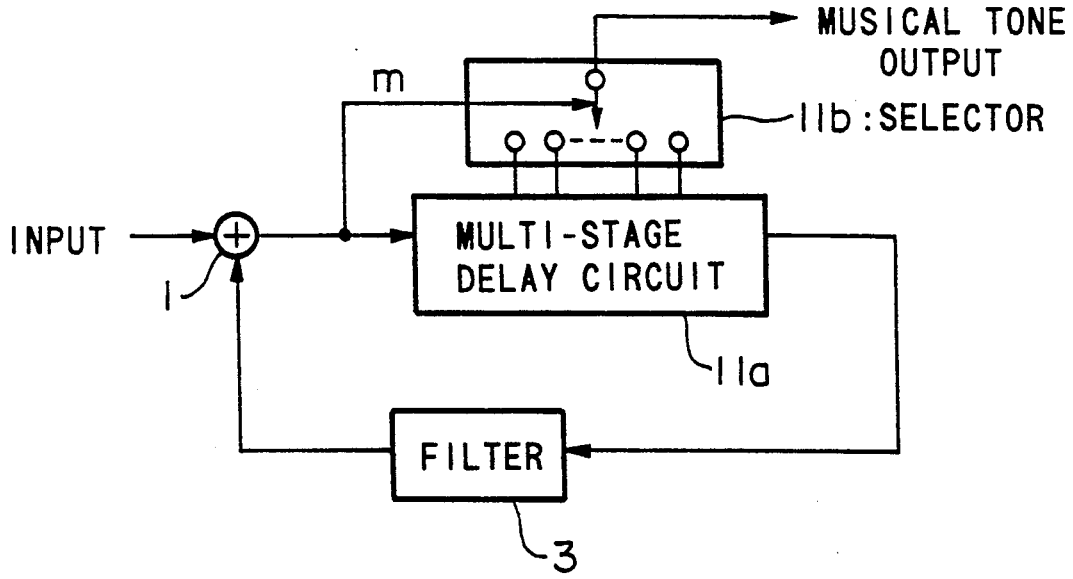
FIG. 2 is a block diagram showing an electric configuration of the musical tone synthesizing apparatus according to a first embodiment of the present invention.

FIG. 2 shows the musical tone synthesizing apparatus according to the first embodiment of the present inventoin, wherein parts identical to those shown in FIG. 1 will be designated by the same numerals. In contrast to the foregoing conventional apparatus as shown in FIG. 1, the output of adder 1 is supplied to the filter 3 via a multi-stage delay circuit 11*a* in FIG. 2. In addition, one of delay outputs of the multi-stage delay circuit 11*a* is selectively outputted as the musical tone output via a selector 11*b*. Further, the output of adder 1 is also used as a modulation signal m to be supplied to the selector 11*b*.

In order to generate the percussion instrument tone from the present musical tone synthesizing apparatus, an impulse signal containing a plenty of different frequency components is applied to the adder 1. This impulse signal is delayed by the multi-stage delay circuit 11*a*, attenuated by the filter 3 and then fed back to the adder 1. In short, the impulse signal is repeatedly circulating through a closed-loop consisting of the adder 1, multi-stage delay circuit 11*a* and the filter 3. In such signal circulating the closed-loop, the envelope is attenuated in lapse of time, and each of frequency components is varied in lapse of time.

One of delay outputs of the multi-stage delay circuit 11*a* is selected by the selector 11*b* in response to the modulation signal m, and then the selected delay output is to be outputted as the musical tone output. Herein, delay outputs of the multi-stage delay circuit 11*a* correspond to a series of sample values which can be obtained by carrying out the sampling operation on the signal circulating the closed-loop at the sampling points based on different time axes respectively. Therefore, the process of selecting one of delay outputs in response to the modulation signal m is equivalent to the process of producing the frequency-modulated signal which is obtained by modulating the signal transmitting through the multi-stage delay circuit 11*a* by the modulation signal m. Thus, the musical tone signal to be outputted is identical to the frequency-modulated signal which is obtained by modulating the signal propagating through the multi-stage delay circuit 11*a* by the output of adder 1. According to first embodiment, the musical tone signal itself is subject to the frequency modulation by every timing. Therefore, the first embodiment can synthesize the musical tone which is quite similar to the actual sound of percussion instrument.

In FIG. 2, delay outputs of the multi-stage delay circuit 11*a* indicate sample values which are discontinuous with respect to time. For this reason, when one of the delay outputs is selectively changed over, there is a possibility in that the noise must be contained in the musical tone output. In order to avoid such noise, the linear interpolation circuit can be adopted instead of the selector 11*b* shown in FIG. 2, for example.

Figure 3:
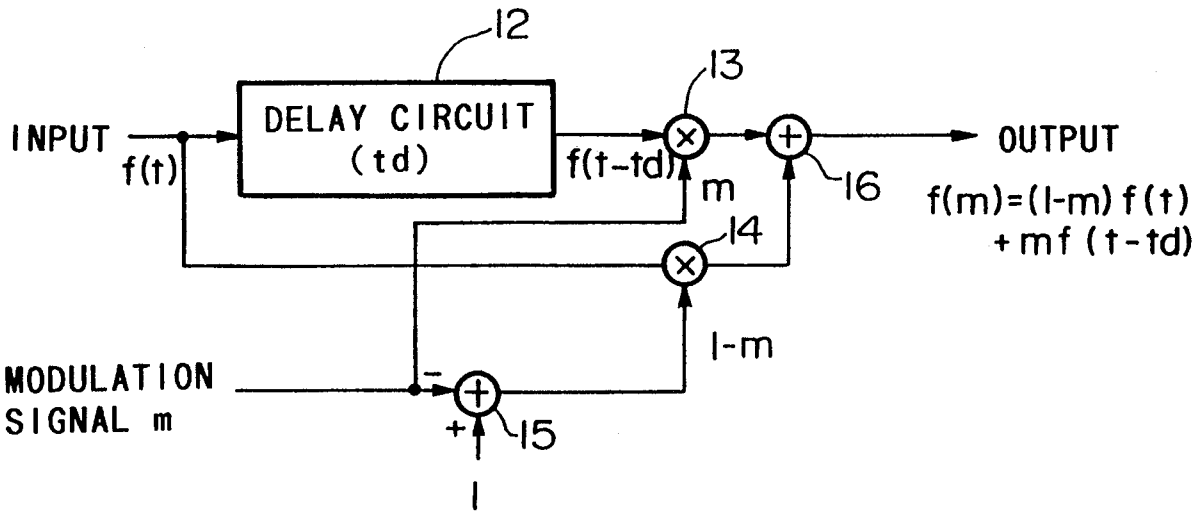
FIG. 3 is a block diagram showing a linear interpolation circuit which can be applied to the first embodiment shown in FIG. 2.

FIG. 3 shows an example of the linear interpolation circuit which is constructed by a delay circuit 12 having delay time td, multipliers 13, 14, a subtractor 15 and an adder 16.

At time t when signal f(t) is applied to the linear interpolation circuit as shown in FIG. 3, such signal f(t) is delayed by the delay time td in the delay circuit 12 and then supplied to the multiplier 13. Therefore, at the present time t, the multiplier 14 receives the signal f(t), while the multiplier 13 receives signal f(t-td) whose timing is prior to the present time t by td. Meanwhile, the multiplier 13 also receives the modulation signal m as its multiplication coefficient. On the other hand, the subtractor 15 subtracts the modulation signal m from value "1", and then its subtraction result, i.e., "1-m" is supplied to the multiplier 14 as its multiplication coefficient. Herein, the modulation signal m designates the decimal value which ranges from "0" to "1". Thereafter, the adder 16 adds the multiplication results of the multipliers 13, 14 together, so that the addition result thereof, i.e., f(m) will be represented by the following formula (1 ).

$$f(m)=(1-m)f(t)+m\,f(t-td) \quad (1)$$

As indicated by the above formula (1), the linear interpolation circuit shown in FIG. 3 can carry out the linear interpolation on two signals f(t), f(t-td) to thereby calculate the signal f(m) corresponding to the modulation signal m.

By replacing the multi-stage delay circuit 11*a* and selector 11*b*by the linear interpolation circuit shown in FIG. 3 in the circuit shown in FIG. 2 so that the output of adder 1 is supplied to the linear interpolation circuit as its input signal f(t) and modulation signal m, the linear interpolation circuit can output the musical tone signal which is obtained by effecting the frequency modulation on the output of adder 1. In this case, the frequency modulation is carried out continuously with respect to time, which avoids the change-over noise to be produced. Thus, it is possible to obtain the musical tone signal with high quality.

[B] SECOND EMBODIMENT

Figure 4:
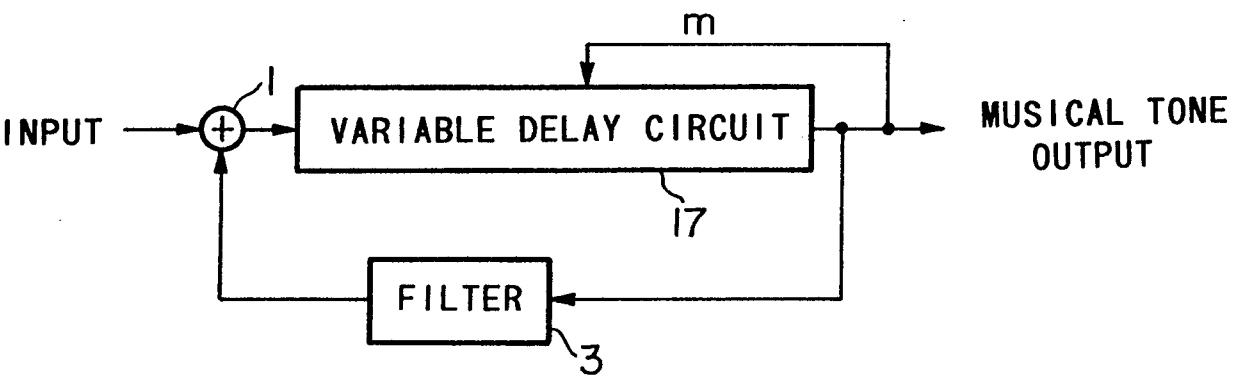
FIGS. 4, 5, 6, 7, 8 are block diagrams respectively showing second, third, fourth, fifth, sixth embodiments of the present invention.

FIG. 4 shows the musical tone synthesizing apparatus according to the second embodiment of the present invention. The second embodiment is characterized by providing a variable delay circuit 17. Herein, the output of adder 1 is supplied to the filter 3 via the variable delay circuit 17. As the variable delay circuit 17 which can adjust its delay time by the modulation signal, it is possible to use the multi-stage delay circuit 11*a* , sensor 11*b* shown in FIG. 2 or linear interpolation circuit shown in FIG. 3.

Figure 5:
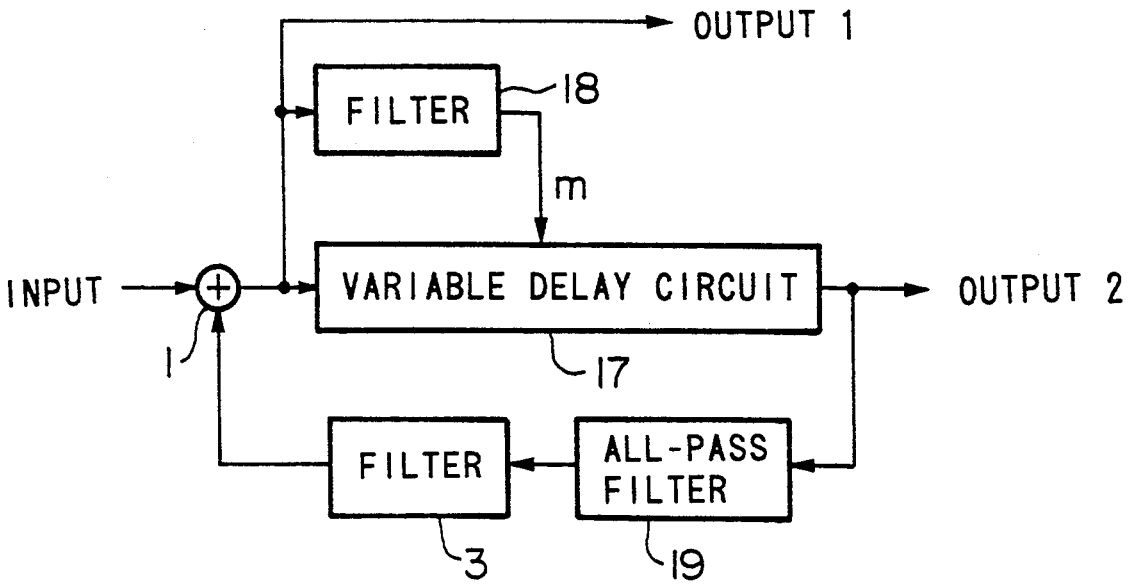

In the second embodiment, the delay time of the variable delay circuit 17 is designed to be controlled by its output signal. In other words, the second embodiment is designed to vary the total delay time of the closed-loop consisting of the adder 1, variable delay circuit 17 and filter 3 in response to the musical tone signal. Thus, the second embodiment can output the frequency-modulated musical tone signal. For the reason described above, the second embodiment can generate the musical tone signal which is quite similar to the actual sound of percussion instrument. [C] THIRD EMBODIMENT FIG. 5 shows the musical tone synthesizing apparatus according to the third embodiment. As comparing to the foregoing second embodiment shown in FIG. 4, the third embodiment is characterized by providing a filter 18 (e.g., band-pass filter) and an all-pass filter 19. More specifically, the output of adder 1 is supplied to the filter 18 wherein its frequency range is limited to the predetermined frequency band. Then, the output of filter 18 is used as the modulation signal m which is supplied to the variable delay circuit 17. In addition, the all-pass filter 19 is inserted between the variable delay circuit 17 and filter 3.

Figure 6:
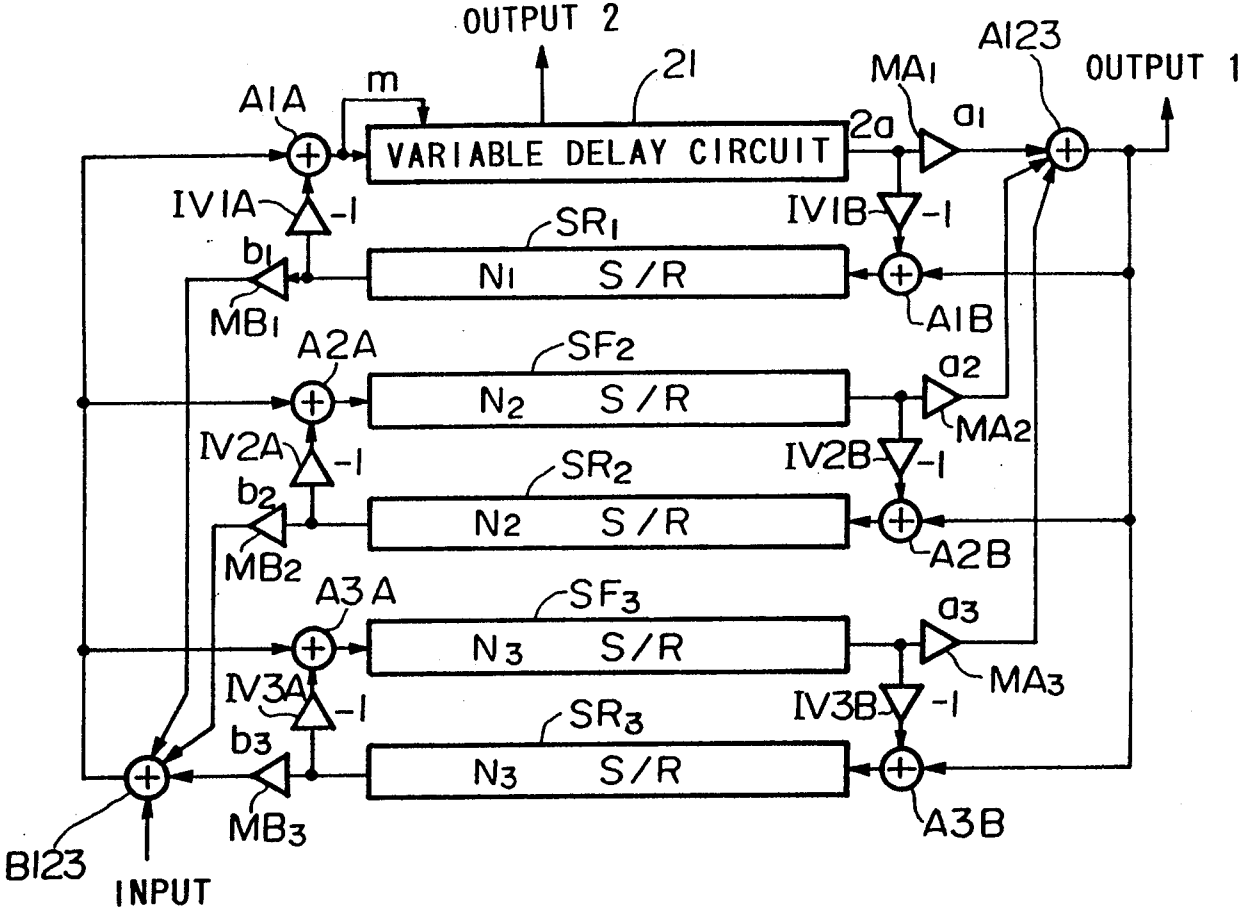

As described above, the filter 18 is designed to limit the frequency range of the output of adder 1. Therefore, if the filter 18 is designed as the low-pass filter, it is possible to filter the lower-frequency component only from the output of adder 1, for example. Therefore, when using such output of filter 18 as the modulation signal m, the frequency-modulation control can be improved in the third embodiment as comparing to the first and second embodiments. Meanwhile, the phase difference between the input and output of the all-pass filter 19 can be varied in response to the signal frequency. Therefore, as the signal repeatedly circulates through the closed-loop consisting of the adder 1, variable delay circuit 17, all-pass filter 19 and filter 3, the phase difference between the frequency components of the circulating signal can be varied. Thus, the third component can generate the simulated percussion instrument tone with high-fidelity to the actual sound of percussion instrument. Incidentally, as the output point from which the musical tone output is picked up, it is possible to use any one of "OUTPUT 1" (corresponding to the output of adder 1) and "OUTPUT 2" (corresponding to the output of variable delay circuit 17). As comparing to "OUTPUT 2", "OUTPUT 1" is advantageous in that the time difference between the leading edges of the input signal and musical tone waveform to be produced can be shortened. [D] FOURTH EMBODIMENT FIG. 6 shows the musical tone synthesizing apparatus according to the fourth embodiment. In FIG. 6, $SR_1$, $SF_2$, $SR_2$, $SF_3$, $SR_3$ designate shift registers each constructed by several flip-flops of which number corresponds to the bit number of data to be transmitted thereto. In addition, each flip-flop is driven by the common clock. 21 designates the variable delay circuit which is similar to the foregoing variable delay circuit 17 shown in FIGS. 4 and 5. This variable delay circuit 21 delays its input signal by the predetermined delay time and then outputs as a first output signal *2a*. In addition, the variable delay circuit 21 also outputs a second output signal "OUTPUT 2" which is delayed by another delay time corresponding to the modulation signal m (i.e., the input of variable delay circuit 21). In FIG. 6, IV1A, IV1B, IV2A, IV2B, IV3A, IV3B designate inverters; $MA_1$, $MB_1$, $MA_2$, $MB_2$, $MA_3$, $MB_3$ designate multipliers each multiplying its input data by the predetermined coefficient; and A1A, A1B, A2A, A2B, A3A, A3B, A123, B123 designate adders.

Herein, a pair of the variable delay circuit 21 and shift register $SR_1$ constructs the resonance circuit. Similarly, a pair of the shift registers $SF_2$, $SR_2$ and a pair of the shift registers $SF_3$, $SR_3$ also construct the resonance circuits respectively. These resonance circuits simulate the resonance phenomenon which is occurred when playing the percussion instrument such as the symbal, drum etc. For example, once the vibration is occurred in the cymbal, the vibration is continued when the cymbal is in the resonance state. In this case, it is imagined that the cymbal may provide quite a large number of propagation paths each propagating the vibration. In other words, the cymbal may have quite a large number of different resonance frequencies. In order to reproduce the resonance phenomenon of the cymbal, the present embodiment provides three resonance circuits as described above. In the present embodiment, numbers $N_1$, $N_2$, $N_3$ of the flip-flops provided in the shift registers and whole delay time of the variable delay circuit 21 are determined in accordance with the main resonance frequency of the percussion instrument to be simulated.

Next, description will be given with respect to the operation of the fourth embodiment. In order to generate the musical tone from the musical tone synthesizing apparatus according to the fourth embodiment, the impulse signal is applied to the adder B123. This impulse signal is applied to the adder B123, from which the impulse signal is supplied to the variable delay circuit 21 and shift registers $SF_2$, $SF_3$ via the adders A1A, A2A, A3A respectively. The variable delay circuit 21 delays its input signal, and then the delayed signal is inverted by the inverter IV1B. The output of inverter IV1B which passes through the adder A1B is delayed by the predetermined delay time in the shift register $SR_1$. Then, the output of shift register $SR_1$ is fed back to the adder A1A via the inverter IV1A. Thus, transmission path consisting of A1A, 21, IV1B, $SR_1$, IV1A can simulate the reciprocating phenomenon of the air vibration in the percussion instrument. Similarly, the output of adder B123 is reciprocated in other transmission paths including the shift register $SF_2$, $SR_2$ and $SF_3$, $SR_3$.

Meanwhile, outputs of the variable delay circuit 21 and shift registers $SF_2$, $SF_3$ are multiplied by the predetermined loss coefficients $a_a$, $a_2$, $a_3$ in the multipliers $MA_1$, $MA_2$, $MA_3$ respectively. Thereafter, the multiplication results of multipliers $MA_1$, $MA_2$, $MA_3$ are added together in the adder A123. Then, the output of adder A123 is supplied to the adders A1B, A2B, A3B. On the other hand, outputs of the shift register $SR_1$, $SR_2$, $SR_3$ are multiplied by the predetermined coefficients $b_1$, $b_2$, $b_3$ in the multipliers $MB_1$, $MB_2$, $MB_3$ respectively. Thereafter, the outputs of multipliers $MB_1$, $MB_2$, $MB_3$ are added together in the adder B123. Due to the above-mentioned operations, the signals transmitting through the variable delay circuit 21 and shift registers are attenuated in lapse of time, by which the sound attenuation in the percussion instrument can be simulated. Herein, the frequency-modulated musical tone signal which is obtained by modulating the output of adder A1A by the modulation signal m is outputted from "OUTPUT 2" of the variable delay circuit 21. In addition, the adder A123 can output the musical tone signal which is not subject to the frequency modulation.

In the above-mentioned embodiments, the signal used in the musical tone synthesizing apparatus itself is used as the modulation signal m. However, it is possible to modify the present embodiments such that the modulation signal is supplied from the external device. When constructing the apparatus by use of the digital circuits, random-access memory (RAM) can be adopted as the variable delay circuit. In addition, it is possible to provide plural circuit units each constructed as shown in FIGS. 2 to 6 to thereby construct one musical tone synthesizing apparatus. In this case, the signal which propagates certain circuit unit can be used as the modulation signal to be supplied to another circuit unit. In short, the present invention can be embodied by use of any kinds of circuits, e.g., digital circuits, analog circuits and the like. For example, the present invention can be embodied by operational processes to be executed in the digital signal processor (DSP) and the like.

[E] FIFTH EMBODIMENT

Figure 7:
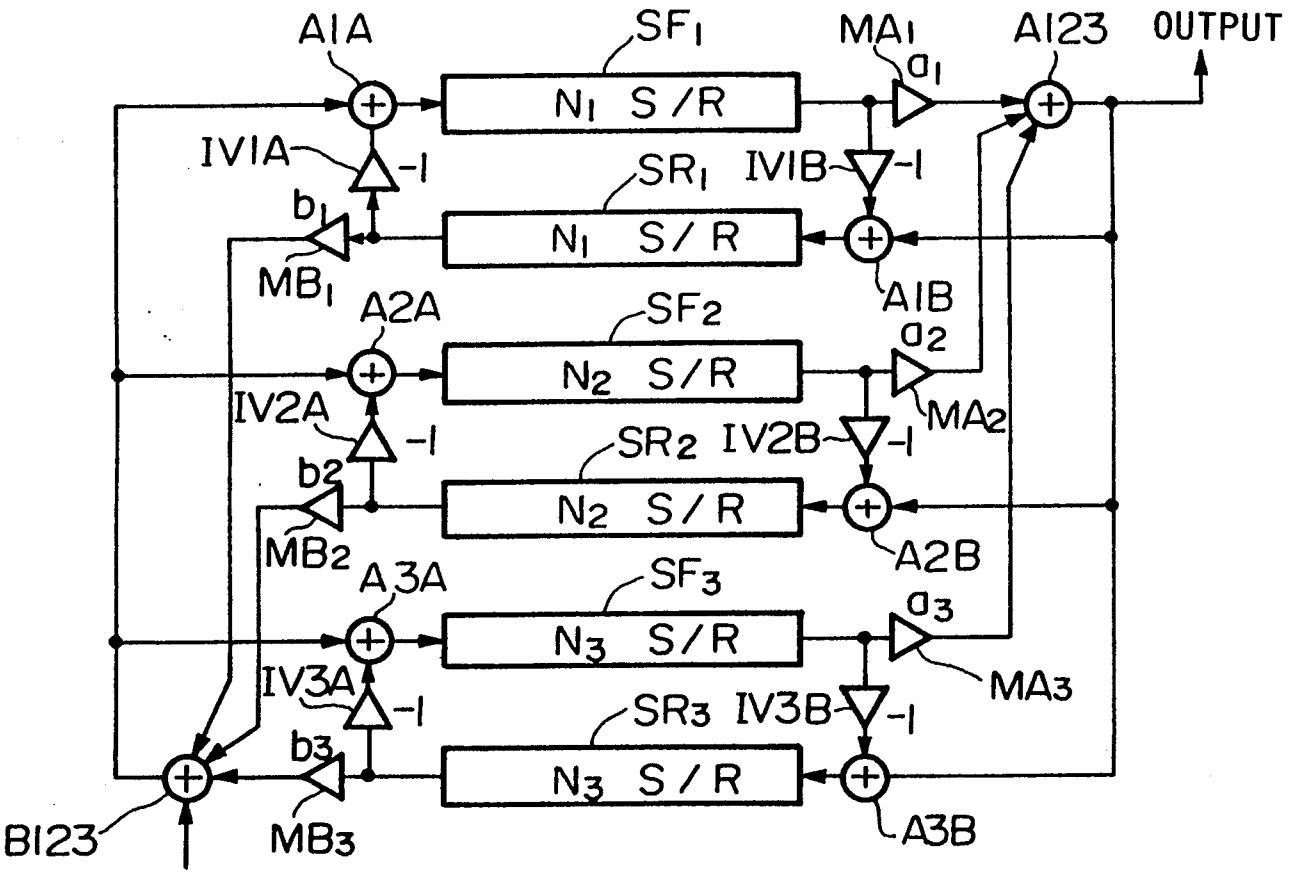

FIG. 7 shows the musical tone synthesizing apparatus according to the fifth embodiment, wherein parts identical to those shown in FIG. 6 will be designated by the same numerals, hence, description thereof will be omitted.

Different from the foregoing fourth embodiment, the fifth embodiment uses a shift register $SF_1$ including $N_1$ stages of flip-flops. Herein, the output of adder A1A is delayed by the shift register $SF_1$and then supplied to the multiplier $MA_1$ and an inverter IV1B.

Herein, it is possible to modify the fifth embodiment such that the musical tone output is not picked up from the adder A123. More specifically, two delayed outputs are respectively picked up from the middle-stages of the shift registers $SF_1$, $SR_1$, and the combined together with desirable signal combining ratio. Thus, the combined signal is picked up as the musical tone output.

[F] SIXTH EMBODIMENT

Figure 8:
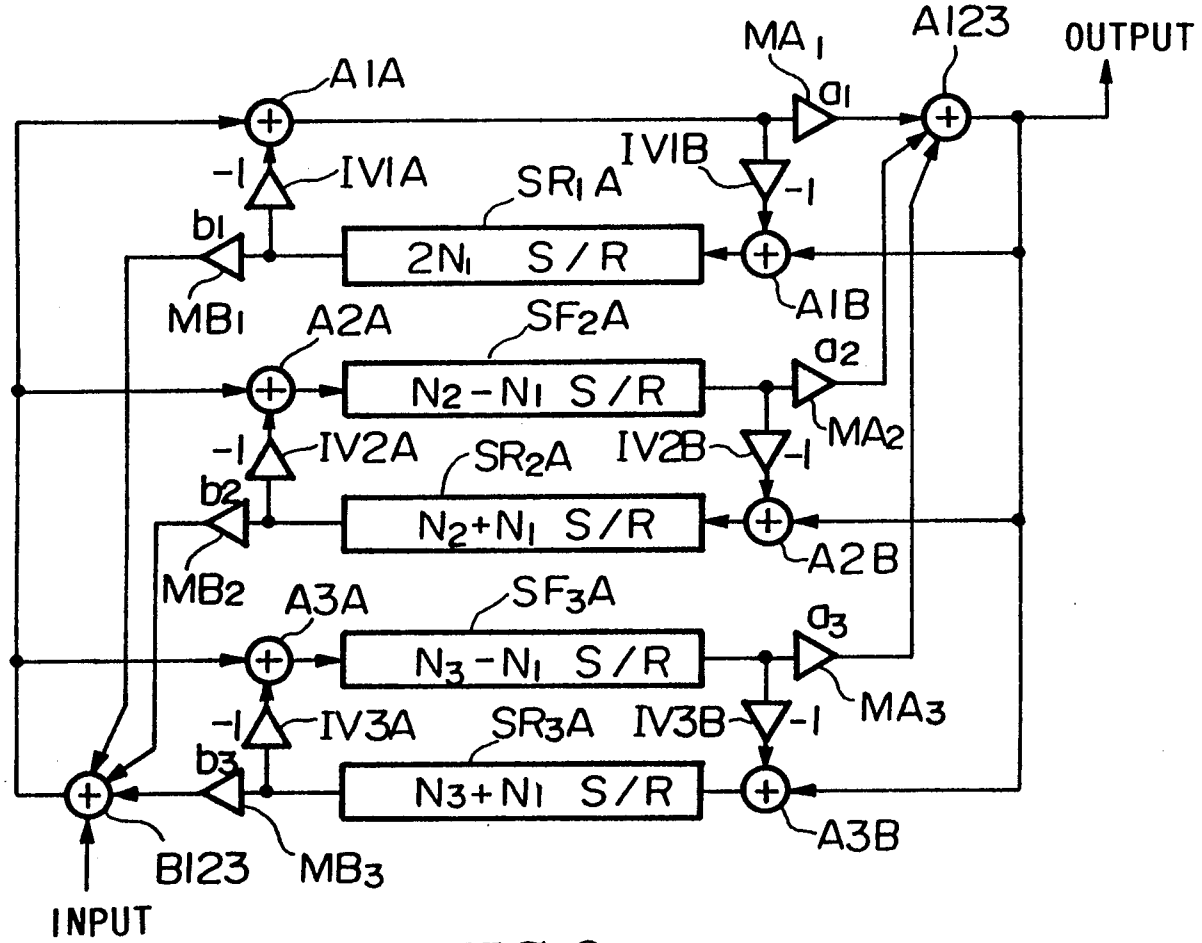

FIG. 8 shows the musical tone synthesizing apparatus according to the sixth embodiment. As comparing to the foregoing fifth embodiment, the shift registers $SF_1$ is omitted, and the shift registers $SR_1$ ($N_1$ stages), $SF_2$($N_2$ stages), $SR_2$ ($N_2$stages), $SF_3$ ($N_3$ stages), $SR_3$($N_3$ stages) are replaced by shift registers $SR_1A$ ($2N_1$stages), $SF_2A$ ($N_2-N_1$) stages), $SR_2A$ ($N_2+N_1$ ) stages, $SF_3A$ ($N_3-N_1$ stages), $SR_3A$ ($N_3+N_1$ stages) respectively.

By omitting the shift register $SF_1$, the period between first timing when the impulse signal is applied to the adder B123 and second timing when the synthesized percussion instrument tone is firstly generated can be shortened as comparing to the fifth embodiment. As similar to the fifth embodiment shown in FIG. 7, phase difference between the input and output to be picked up at the adders A1A, A1B corresponds to $2N_1$ stages of the flip-flops; phase difference between the input and output to be picked up at the adders A2A, A2B corresponds to $2N_2$stages of the flip-flops; and phase difference between the input and output to be picked up at the adders A3A, A3B corresponds to $2N_3$ stages of the flip-flops in the sixth embodiment shown in FIG. 8. Therefore, phase differences between signals to be added in the adders A123, B123 of the sixth embodiment are similar to those of the fifth embodiment. In short, the sixth embodiment can perform the signal processing similar to that of the fifth embodiment.

Incidentally, in order to generate the percussion instrument tone, the impulse signal is applied to the adder B123 as the input signal in general. However, instead of such impulse signal, it is possible to use the sweep signal of which frequency varies like the sawtooth in lapse of time as the input signal applied to the musical tone synthesizing apparatus.

Further, it is possible to employ the analog signal which is produced by beating the piezo-electric sensor and the like as the input signal of the musical tone synthesizing apparatus. In this case, such analog signal may include the information representative of the beating force, hardness of the object to be beaten, beating manner and the like. Therefore, it is possible to obtain the simulated percussion instrument tone with high-fidelity to the actual sound of percussion instrument. This, in addition to the synthesis of percussion instrument tone, the present invention can be applied to the synthesis of other kinds of non-electronic instrument tones of reverberation tone.

As described heretofore, this invention may be practiced or embodied in still other ways withouts departing from the spirit of essential character thereof. Therefore, the preferred embodiments described herein are illustrative and not restrictive, the scope of the invention being indicated by the appended claims and all variations which come within the meaning of the claims are intended to be embraced therein.

What is claimed is:

1. A musical tone synthesizing apparatus comprising:
(a) adder means for adding an input signal to a feedback signal, said input signal being applied from an external device;
(b) means for generating a modulation signal by extracting a part of an output signal from said adder means;
(c) delay means for delaying an output of said adder means by a predetermined delay time, wherein the delayed output of said delay means is fed back to said adder as said feedback signal, and wherein said predetermined delay time determines frequency components of a tone to be synthesized; and
(d) musical tone extracting means for extracting a signal from different delay amount points of the delay means and varying the point of extraction based on said modulation signal thereby to frequency modulate said frequency components, wherein an output of said extracting means is picked up as a synthesized musical tone signal having a plurality of modulated frequency components.

2. A musical tone synthesizing apparatus comprising:
(a) adder means for directly receiving an input signal from an external device, adding a plurality of feedback signals to the input signal and producing a plurality of output signals each designating a tone having frequency components; and
(b) a plurality of resonance circuits each including delay means each delaying one of said output signals of said adder means, and specific delay time which is different for each delay means are fed wherein the delayed outputs of said plurality of delay means are fed back to said adder means as said plurality of feedback signals,
wherein the output of either said adder means or at least one of the delayed outputs of said plurality of delay means, is picked up as a synthesized musical tone signal having a plurality of frequency components each of which is varied with time.

3. A musical tone synthesizing apparatus according to claim 2 wherein each of said delay means is constructed by a shift register including plural stages of flip-flops.

* * * * *